US005323854A

United States Patent [19]

Pursley, Jr.

[11] Patent Number: 5,323,854

[45] Date of Patent: Jun. 28, 1994

[54] TUBING HANGER SEAL FOR WATER WELLS

[76] Inventor: Harold W. Pursley, Jr., P.O. Box 1, Edinburg, Tex. 78540

[21] Appl. No.: 59,139

[22] Filed: May 10, 1993

[51] Int. Cl.[5] ..... E21B 33/04

[52] U.S. Cl. ..... 166/75.1; 166/82; 166/85; 285/140; 285/147

[58] Field of Search ..... 166/75.1, 81, 82, 85, 166/86; 285/144, 147, 140

[56] References Cited

U.S. PATENT DOCUMENTS

| | | | |
|---|---|---|---|
| 1,297,562 | 3/1919 | Haney | 285/140 |
| 1,498,075 | 6/1924 | Dale | 285/144 |
| 1,519,457 | 12/1924 | Hudson | 285/140 |
| 1,646,639 | 10/1927 | Crowell | 285/140 |
| 1,703,160 | 2/1929 | Morlang et al. | 285/144 |
| 1,904,926 | 4/1933 | Peters | 166/75.1 |
| 2,173,037 | 9/1939 | Dailey | 285/140 |
| 2,214,208 | 9/1940 | Spreng | 285/140 |
| 2,556,384 | 6/1951 | Zeitz | 166/75.1 X |
| 4,291,767 | 9/1981 | Hall, Jr. | 166/75.1 X |

*Primary Examiner*—Hoang C. Dang
*Attorney, Agent, or Firm*—G. Turner Moller

[57] ABSTRACT

A water well installation includes a seal to prevent animals, insects, roots, dirt, dust or other debris from entering the well through the annulus between the casing and tubing strings. The seal comprises a flat, resilient hard rubber disc having a central opening closely receiving the tubing string therein. The rubber disc is supported on the upper exposed end, either a collar or a tube end, of the casing string or on the top of a concrete pad if one has been poured around the water well.

17 Claims, 1 Drawing Sheet

TUBING HANGER SEAL FOR WATER WELLS

This invention relates to a seal for water wells and more particularly to a seal underneath a tubing hanger for sealing the well against entry by animals, insects, dirt, dust, roots, debris and the like.

In the past, water wells have been completed by running a string of casing into a bore hole into the earth, running a string of tubing into the casing and suspending the tubing with a tubing hanger. Water wells are typically pumped, so a pump is normally run on the bottom of the tubing to pump water up the tubing string to a water delivery system or tank at the surface.

Old fashioned tubing hangers comprise an annular support which rests on the top of the casing or on a cement pad poured around the water well which acts to prevent the earth from collapsing around the casing and causing a sink near the water well. A plurality of jaws or slips fit on the annular support and grip the tubing thereby supporting the tubing. Because of their design, these older tubing hangers are open at the top and therefore allow debris, dust, roots, animals and insects to fall, grow, fly or crawl into the annulus between the tubing and casing strings. This creates an obvious unsanitary situation because no one wants to drink water out of a well into which snakes, lizards, mice and other small creatures have fallen and died.

In response to this obvious situation, more modern tubing hangers have been developed which support the tubing string and seal against the interior wall of the casing. A typical modern water well tubing hanger comprises a pair of half-moon shaped segments having a rubber gasket on the exterior. The segments are bolted together on the tubing at the location where the tubing is to be supported and the hanger forced into the casing so the rubber gasket seals against the inside diameter of the casing. A lip on the segments overlaps the uppermost collar and thereby supports the tubing. Thus, modern tubing hangers not only support the tubing from a location inside the casing but also seal the annulus between the tubing and casing and thereby prevent the entry of undesirable creatures and things into the water well.

U.S. Pat. No. 2,214,208 discloses a water well system which is designed to keep out debris and the like. The disclosures of gaskets and packings from early oil field well heads similar to this invention are found in U.S. Pat. Nos. 1,297,562; 1,646,639 and 2,173,037. As will become apparent, these devices differ from this invention because this invention lacks a casing head which the gasket seats against.

In this invention, an annular resilient disc is passed over the end of the uppermost joint of tubing. The disc rests on the upper end of the uppermost casing joint or on the face of the concrete pad adjacent the water well. In an old well, the old style tubing hanger can be reused and simply rests on top of the resilient disc. Because the load of the tubing string is applied through the tubing hanger and disc, a close fitting seal is provided to seal the annulus against entry of undesirable creatures, dust, dirt and the like thereby making an old well much more sanitary without the expense of a new style tubing hanger.

In reworking old wells, there are many situations where the new style tubing hangers do not work well, if at all. For example, in a well having a concrete pad where the metal casing has corroded off below the top of the concrete pad, there is no pipe for the rubber gasket to seal against. Similarly, it is very difficult to employ modern style tubing hangers in wells where the upper casing end is very corroded because the rubber gasket cannot be forced into the casing string without damaging it further.

In accordance with one embodiment of this invention, a water well installation comprises a casing string extending into the earth consisting essentially of a plurality of joints of threaded tubes having a collar on one end thereof, the casing string providing an uppermost end free of a casing head, a tubing string in the casing comprising a plurality of joints of threaded tubing, means sealing the annulus comprising a resilient disc supported on the uppermost end of the casing string and having a central passage closely receiving the uppermost threaded tubing joint and a tubing hanger supported on the resilient disc and having a plurality of slips therein supporting the tubing.

In accordance with another embodiment of this invention, a water well installation comprises a casing string extending into the earth consisting essentially of a plurality of joints of threaded tubes having a collar on one end thereof, the casing string providing an uppermost end, a concrete pad surrounding the casing string above the level of the uppermost end of the casing string, a tubing string in the casing comprising a plurality of joints of threaded tubing, means sealing the annulus comprising a resilient disc supported on the concrete pad and having a central passage closely receiving the uppermost threaded tubing joint, and a tubing hanger supported on the resilient disc and having a plurality of slips therein supporting the tubing.

It is an object of this invention to provide an inexpensive approach to seal the annulus of a water well.

Another object of this invention is to provide means for sealing the annulus of a water well without the expense of a new tubing hanger.

A further object of this invention is to provide a technique for sealing a water well by forcing a resilient gasket against the exposed upper end of the casing or against the top of a concrete pad adjacent the well.

These and other objects of this invention will become more fully apparent as this description proceeds, reference being made to the accompanying drawings and appended claims.

IN THE DRAWINGS

Figure 1:
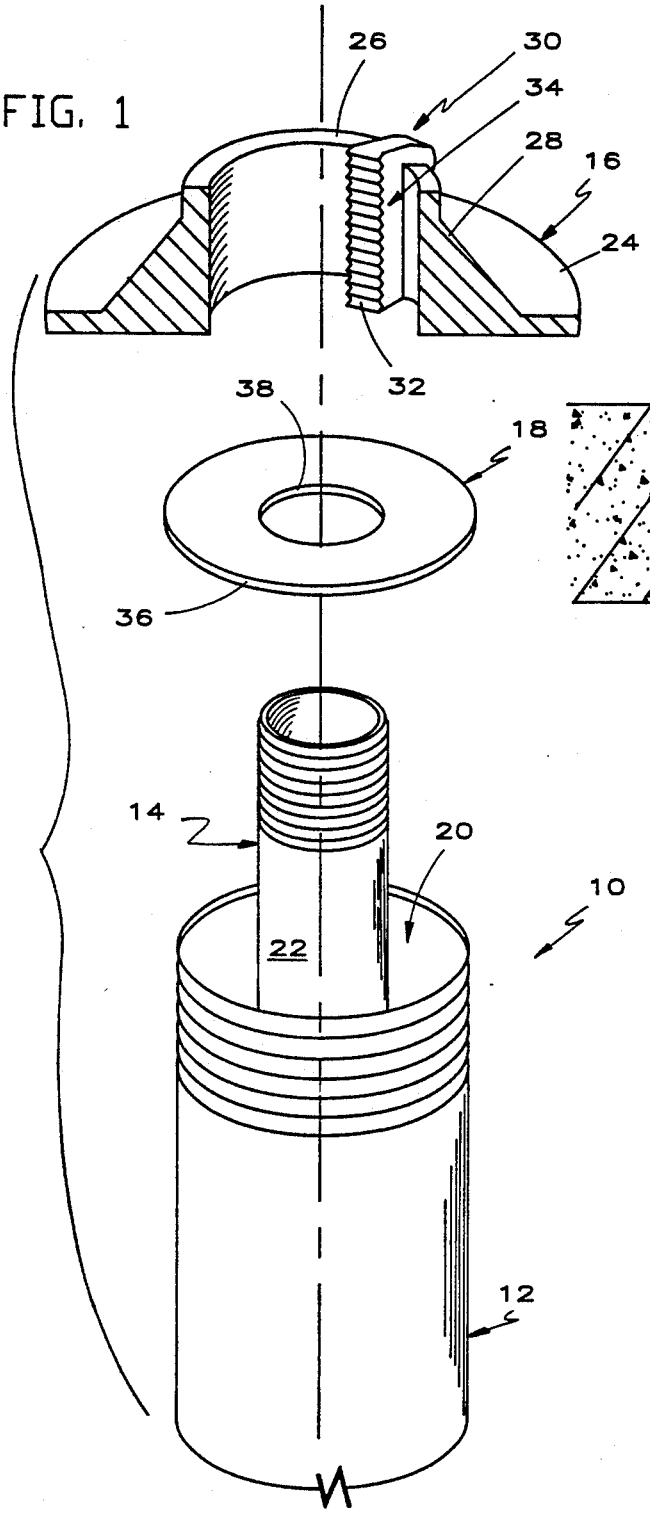
FIG. 1 is an exploded isometric view of this invention employed in a water well.

Referring to FIG. 1, there is illustrated a water well 10 of this invention comprising, as major components, a casing string 12, a tubing string 14, a tubing hanger 16 and means 18 sealing the annulus 20 between the casing and tubing strings 12, 14.

The casing string 12 comprises a series of threaded joints or tubes having a collar (not shown) connecting adjacent joints of casing together. The casing string extends into a bore hole in the earth to a depth sufficient to penetrate a water bearing formation. Typically, the casing string 12 is slotted or perforated in some fashion adjacent the water bearing formation to allow water to enter the casing string. The casing string 12 is of any desired diameter and is usually cemented in the annulus between the casing string 12 and the bore hole.

The tubing string 14 comprises a plurality of threaded joints 22 having collars connecting the joints 22 together. The tubing string 14 may be of any suitable diameter. A suitable pump (not shown) is typically suspended on the bottom of the tubing string 13 and may be driven by electricity supplied through a cable (not shown) on the outside of the tubing or may be driven by sucker rods (not shown) extending downwardly through the tubing in the case of a windmill driven pump.

Figure 2:
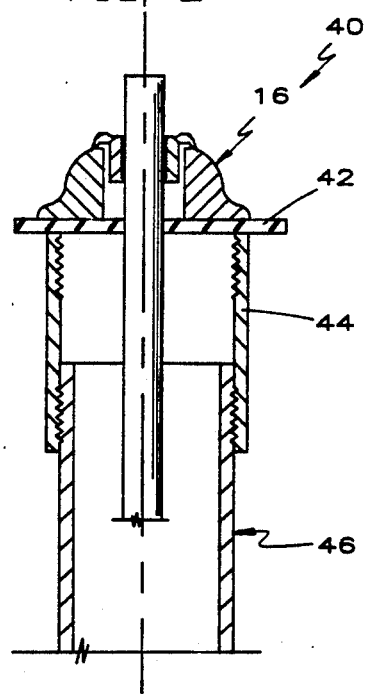
FIG. 2 is a vertical cross-sectional view of a slightly different embodiment of this invention.

The tubing hanger 16 is of an old conventional design and includes a generally annular base 24 having an upstanding central collar or sleeve 26 supported by suitable gussets or reinforcements 28. A plurality, usually three, of dogs or slips 30 provide a series of teeth 32 for gripping the exterior of the uppermost tubing joint and suspending the tubing string 14 inside the casing string 12. There is accordingly a large gap 34 between the dogs 30 and the upstanding collar 26 of the tubing hanger 16 through which dirt, dust, animals, roots and the like can enter a conventional water well 10. The tubing hanger 16 is supported on the upper exposed end of the uppermost casing joint. In the embodiment of FIG. 1, the tubing hanger 16 rests on the upper end of the tube comprising the uppermost joint of the casing string 12. In the embodiment of FIG. 2, the tubing hanger 16 rests on the upper end of the collar comprising the uppermost joint of the casing string 12. Those skilled in the art will recognize the water well 10, as heretofore described, to be typical of an older style water well installation common in the southwest.

The sealing means 18 comprises a disc 36 of a size larger than the diameter of the uppermost casing joint having a central opening 38 closely receiving the uppermost tubing joint 22. Although the disc 36 is illustrated to be circular, this is not crucial because any excess material overlapping the outside of the casing 12 is not harmful except for aesthetics. The material of the disc should be sufficiently tough to withstand any cutting action between the top of the casing string 12 and the base 24 of the tubing hanger. Preferably, the disc 36 is of a resilient material to accommodate irregularities between the bottom of the tubing hanger 16 and the top of the casing string 12 and to seal on the inner diameter against the uppermost tubing joint 22.

Although the disc 36 may be of any suitable thickness and material, a hard rubber sheet about ¼ inch thick having a hardness in the range of about 70–90 Durometer and preferably on the order of about 80 Durometer has proven successful. When the tubing hanger 16 is assembled and supporting the tubing string 14 inside the casing string 12, it will be apparent that the disc 36 prevents entry of dirt, animals, insects or other debris through the gap 34 into the annulus between the casing and tubing strings 12, 14. It will accordingly be seen that the disc 36 abuts and seals against the casing string 12 and not a casing head attached to the upper end of the casing string 12. Those skilled in the art will recognize a casing head as being much shorter than a joint of pipe but longer than a collar, of heavier construction than either the pipe joint or the collar and including special means for receiving sealing gaskets, O-rings and the like.

Referring to FIG. 2, the water well installation 40 differs from the installation 10 only in the fact that the sealing disc 42 rests on the exposed end of an uppermost collar 44 comprising the uppermost end of the casing string 46. It will be apparent to those skilled in the art that the casing strings of water wells usually terminate in a collar, but such is not essential as shown in FIG. 1. It will accordingly be seen that the disc 42 abuts and seals against the casing string 46 and not a casing head attached to the upper end of the casing string 46.

Figure 3:
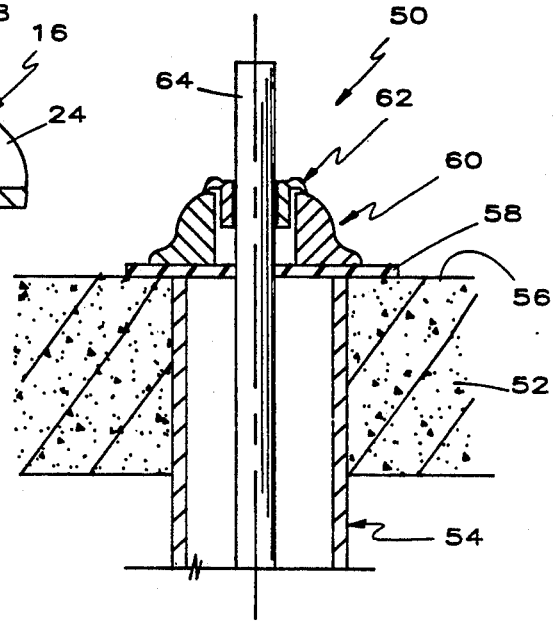
FIG. 3 is a vertical cross-sectional view of this invention employed in a water well provided with a concrete pad surrounding the well.

Referring to FIG. 3, the installation 50 illustrates another common conventional water well installation where a concrete pad 52 has been poured around the casing string 54 to prevent the earth from caving in around the outside of the casing string 54. Typically, the top 56 of the concrete pad 52 is at or slightly above the top of the casing string 54. It often happens that the uppermost collar or joint of the casing string 54 corrodes to a condition where the uppermost end of the casing string 54 is several inches below the top 56 of the concrete pad 52.

In installations like FIG. 3, the sealing disc 58 of this invention is placed on and seals on the outer diameter thereof against the top 56 of the concrete pad 52. The tubing hanger 60 is placed on top of the disc 58 and the slips 62 support the tubing string 64 in a conventional manner. The inner diameter of the disc 58 seals against the tubing string 64. It will accordingly be apparent that the disc 58 seals against the entry of dirt, dust, roots and animals into the annulus between the tubing string 64 and the casing string 54.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A water well comprising a casing string extending into the earth consisting essentially of a plurality of joints of threaded tubes having a collar on one end thereof, the casing string providing an uppermost end free of a casing head;

a tubing string in the casing comprising a plurality of joints of threaded tubing and defining, with the casing string, an annulus;

means sealing the annulus comprising a disc supported on the uppermost end of the casing string and having a central passage closely receiving the uppermost threaded tubing joint; and a tubing hanger supported on the disc and having a plurality of slips supporting the tubing.

2. The water well of claim 1 wherein the uppermost end of the casing string is taken from the group consisting essentially of an uppermost threaded tube and an uppermost collar.

3. The water well of claim 1 wherein the uppermost end of the casing string is an uppermost end of a threaded tube.

4. The water well of claim 1 wherein the uppermost end of the casing string is a collar.

5. The water well of claim 1 wherein the disc is flat and is of a resilient material.

6. The water well of claim 5 wherein the disc is of a rubber-like material having a hardness in the range of 70–90 Durometer.

7. The water well of claim 1 wherein the tubing hanger comprises a base having generally flat bottom abutting the disc and a central upstanding sleeve receiving the tubing string, the slips being between the sleeve and the tubing string, there being a gap provided between the sleeve, the tubing string and the slips.

8. The water well of claim 7 wherein the disc is flat and is of a resilient material.

9. The water well of claim 8 wherein the disc is of a rubber-like material having a hardness in the range of 70–90 Durometer.

10. A water well comprising a casing string extending into the earth consisting essentially of a plurality of joints of threaded tubes having a collar on one end thereof, the casing string providing an uppermost end;

a concrete pad surrounding the casing string above the level of the uppermost end of the casing string;

a tubing string in the casing comprising a plurality of joints of threaded tubing and defining, with the casing string, an annulus;

means sealing the annulus comprising a disc supported on the concrete pad and having a central passage closely receiving the uppermost threaded tubing joint; and a tubing hanger supported on the disc and having a plurality of slips supporting the tubing.

11. The water well of claim 10 wherein the concrete pad provides a generally flat top, the tubing hanger being supported on the flat top of the concrete pad.

12. The water well of claim 10 wherein the uppermost end of the casing string is taken from the group consisting essentially of an uppermost threaded tube and an uppermost collar.

13. The water well of claim 10 wherein the uppermost end of the casing string is an uppermost end of a threaded tube.

14. The water well of claim 10 wherein the uppermost end of the casing string is a collar.

15. The water well of claim 10 wherein the tubing hanger comprises a base having generally flat bottom abutting the disc and a central upstanding sleeve receiving the tubing string, the slips being between the sleeve and the tubing string, there being a gap provided between the sleeve, the tubing string and the slips.

16. A water well comprising a casing string extending into the earth comprising a plurality of joints of threaded tubes having a collar on one end thereof, the casing string providing an uppermost end free of a casing head;

a tubing string in the casing string comprising a plurality of joints of threaded tubing and defining, with the casing string, an annulus;

means sealing the annulus comprising a resilient disc having a central passage closely receiving the uppermost threaded tubing joint and sealing against the tubing string and means sealing between the disc and the casing string; and a tubing hanger supported on the resilient disc and having a plurality of slips supporting the tubing.

17. The water well of claim 16 wherein the tubing hanger comprises a base having generally flat bottom abutting the disc and a central upstanding sleeve receiving the tubing string, the slips being between the sleeve and the tubing string, there being a gap provided between the sleeve, the tubing string and the slips.

* * * * *